United States Patent [19]

Flory, IV et al.

[11] Patent Number: 5,019,751

[45] Date of Patent: May 28, 1991

[54] END-OF-LIFE LAMP STARTER DISABLING CIRCUIT

[75] Inventors: Isaac L. Flory, IV; Joe A. Nuckolls, both of Blacksburg, Va.

[73] Assignee: Hubbell Incorporated, Orange, Conn.

[21] Appl. No.: 407,616

[22] Filed: Sep. 15, 1989

[51] Int. Cl.[5] ..... H05B 41/14

[52] U.S. Cl. ..... 315/290; 315/119; 315/225; 315/DIG. 7

[58] Field of Search ..... 315/290, 289, 205, 73, 315/74, 104, 106, 107

[56] References Cited

U.S. PATENT DOCUMENTS

| | | | |
|---|---|---|---|
| 3,699,385 | 10/1972 | Paget | 315/239 |
| 4,179,641 | 12/1979 | Britton | 315/289 |
| 4,207,500 | 6/1980 | Duve et al. | 315/289 |
| 4,433,272 | 2/1984 | Ogawa | 315/290 |
| 4,461,980 | 7/1984 | Nilssen | 315/225 |
| 4,763,044 | 8/1988 | Nuckolls et al. | 315/176 |

FOREIGN PATENT DOCUMENTS

| | | | |
|---|---|---|---|
| 2312167 | 12/1976 | France | 315/290 |
| 0010584 | 1/1979 | Japan | 315/290 |

*Primary Examiner*—Eugene R. Laroche
*Assistant Examiner*—Son Dinh
*Attorney, Agent, or Firm*—Jerry M. Presson; Walter C. Farley

[57] ABSTRACT

A disabling circuit for deactivating a high pressure sodium lamp starting and operating circuit when the lamp exhibits end-of-life cycling includes a normally closed thermal switch connected to the starting and operating circuit is inoperative, the switch having contacts which open in response to an elevated temperature. A heating element is connected in parallel with the lamp so that the voltage across the lamp is applied to the heating element. The heating element is supported in a selected heat conducting relationship with the thermal switch so that a predetermined elevated temperature is reached and the contacts are opened only after the dissipation of an amount of energy resulting from repeatedly high lamp open-circuit voltage accompanying end-of-life cycling.

9 Claims, 2 Drawing Sheets

END-OF-LIFE LAMP STARTER DISABLING CIRCUIT

SPECIFICATION

This invention relates to circuit means for disabling a starting aid or the operating circuit for a high pressure sodium lamp when the lamp behaves in such a way that the end of its life is clearly approaching.

BACKGROUND OF THE INVENTION

High pressure sodium lamps inherently exhibit an end of life condition by "cycling". The classical description of cycling of a high pressure sodium lamp is that the lamp voltage rises to a point at which the ballast can no longer maintain the arc. The lamp then extinguishes and the restarting process begins. In the restart process, the starter or ignitor imposes the same high-voltage, high-frequency pulses which are used for ignition of a cold lamp. However, when the lamp is in a hot, deionized state, the re-strike time can be up to several minutes in length as compared with a substantially instant cold start condition. This restart procedure will continue as the failing lamp warms up and cycles again. The process of cycling repeats, becoming more frequent until the lamp fails completely. When that happens, the starter continues its high-voltage pulsing which stresses the dielectric system of the lighting fixture.

If cycling were unique to the end-of-life condition of a high pressure sodium lamp, the process of protecting the electrical integrity of the fixture would be relatively simple. Unfortunately, a condition very similar to end-of-life cycling can occur with new or, at least, quite usable, functional high pressure sodium lamps. New lamps often cycle due to an initial, but self-correcting, problem with the amalgam inside of the arc tube. Functioning lamps will also cycle in response to a drop in supply voltage, as will all high intensity discharge lamps. To totally disable the starter in these two situations would be wasteful because of lost operating time as well as the possibility of a good lamp being mistaken for a bad one.

SUMMARY OF THE INVENTION

Accordingly, an object of the present invention provides a circuit which is capable of distinguishing between the cycling resulting from an end-of-life condition and cycling due to other causes, and for disabling the starting mechanism when the lamp has reached the end of its useful life.

Briefly described, the invention comprises a disabling circuit for deactivating a high pressure sodium lamp starting and operating circuit when the lamp exhibits end-of-life cycling, the starting and operating circuit being of the type having an AC power source, a ballast connected to the AC source, starting circuit means for supplying high voltage, high frequency pulses to start an extinguished lamp and lamp circuit means for connecting the starting and operating circuit to a high pressure sodium lamp. The disabling circuit comprises the combination of a normally closed thermal switch connected in circuit relationship with the starting and operating circuit such that when the switch is open the starting and operating circuit is inoperative, the switch having contacts which open in response to a predetermined elevated temperature. A heating element is connected in parallel circuit relationship with the lamp circuit means so that the voltage across the lamp is applied to the heating element. The heating element is supported in a selected heat conducting relationship with the thermal switch so that the predetermined elevated temperature is reached and the contacts are opened only after an interval of time and after the dissipation of an amount of energy resulting from repeatedly high lamp open-circuit voltage of a type which accompanies end-of-life cycling.

BRIEF DESCRIPTION OF THE DRAWINGS

In order to impart full understanding of the manner in which these and other objects are attained in accordance with the invention, particularly advantageous embodiments thereof will be described with reference to the accompanying drawings, which form a part of this specification and wherein.

DESCRIPTION OF THE PREFERRED EMBODIMENTS

Figure 1:
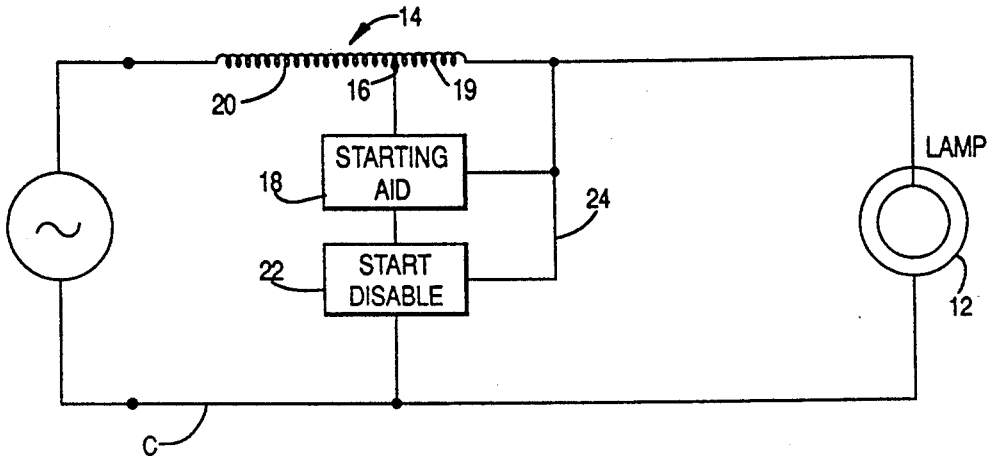
FIG. 1 is a schematic block diagram of a first embodiment of the invention.

Referring first to FIG. 1, an AC power source is shown connected to a starting and operating circuit for a high pressure sodium lamp 12, the starting and operating circuit including a ballast 14 which has a tap at 16 connected to a starting aid circuit 18. The starting aid circuit and ballast are connected to lamp 12, ballast 14 being arranged so that tap 16 defines a primary portion 19 and a secondary portion 20 of the ballast winding, the primary-to-secondary windings ratio being on the order of 1:20 or greater. The starting aid circuit 18 can be any of a variety of well-known starting circuits which are designed to generate a pulse through primary portion 19 which is increased in voltage by the ratio of the primary to secondary portions of ballast 14, producing a high voltage, high frequency sequence of pulses which are applied to lamp 12 to start the lamp. Examples of such circuits can be found in U.S. Pat. Nos. 4,763,044, Nuckolls et al; 4,275,337, Knoble et al; or 3,963,958, Nuckolls. It will also be recognized by those skilled in this art that other ballast arrangements can be used or that a separate pulse transformer can be used. The arrangement thus far described is quite conventional in this art and the characteristic behavior of such a circuit is well understood.

One of the preferred operating characteristics of a starting aid circuit is that it does not operate when the lamp voltage, i.e., the voltage across the lamp terminals, falls below a certain level. Thus, when the lamp is not ignited, the open circuit voltage across the lamp is high and the starting circuit is caused to operate. However, when the lamp ignites and a light-producing arc exists within the lamp, the voltage across the lamp is relatively low and the starting aid circuit is dormant.

As indicated above, the problem arises when the lamp goes through a cycling phase in which the lamp voltage becomes relatively high as compared to the normal operating voltage level. This is due to the aging characteristics of the lamp, causing the lamp to be extinguished because the ballast is no longer capable of supplying adequate current to sustain the arc. As soon as the lamp is extinguished, the starting aid circuit attempts to restart the lamp, applying high-voltage, high-frequency pulses to the lamp in conjunction with ballast 14. If the lamp restarts, the initial starting voltage is likely to be lower than nominal, but in a short interval of time, the lamp voltage again increases to the excessive level, causing it again to extinguish. This is the end-of-life cycling referred to above. This cycling differs from the other kinds of cycling in that it does not cease after just a few cycles. Rather, it continues either until the lamp totally fails or until some other element of the dielectric system is stressed beyond its capacity and fails.

For this reason, the invention involves the incorporation of a disabling circuit 22 which, in the embodiment of FIG. 1, is a three-terminal device having a switchable conductive path connected between the starting aid and the common side of the AC supply. The third terminal is attached to a conductor 24 which, along with the starting aid, is connected to the "hot" side of the lamp. Thus, the lamp voltage, whatever it may be, appears between conductor 24 and the AC common line, placing the lamp voltage directly across the disable circuit. As will be described, when this lamp voltage is high for continuously repeated intervals of time, thereby indicating that the cycling which occurs is end-of-life cycling, the disabling circuit opens the connection between the starting aid and the AC common line, deactivating the starting aid. The exact manner in which this is accomplished will be described in connection with the various embodiments of disabling circuits in the following discussion.

Figure 2:
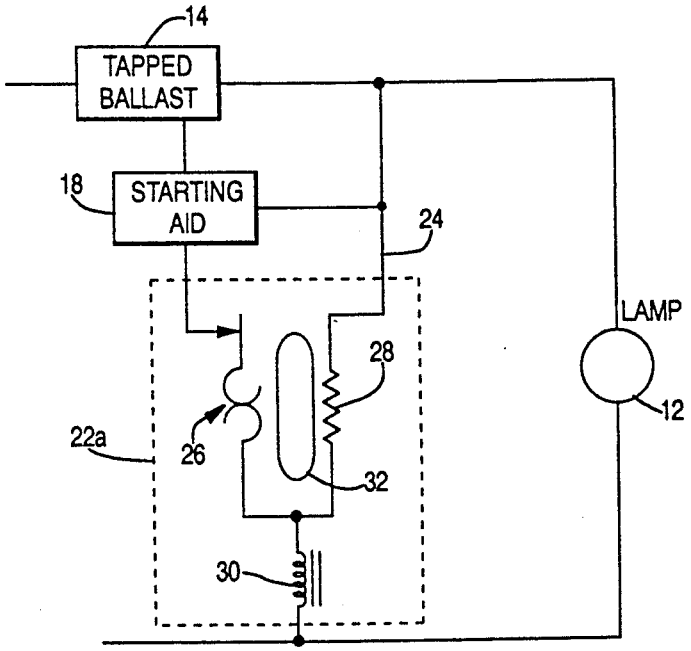
FIG. 2 is a schematic circuit diagram, partly in block form, showing a first embodiment of a disabling circuit in accordance with the invention.

FIG. 2 shows the same circuit, omitting the representation of the source and showing the ballast simply as a block 14. The disabling circuit 22A of FIG. 2 includes a normally closed thermally actuated switch 26 which is connected in series circuit relationship with the starting aid 18 between the starting aid and the common line. A heater resistor 28 is connected between conductor 24 and the common line, the circuit also including a choke coil 30 in series with both switch 26 and heater resistor 28. Choke 30 is a radio frequency choke having a value selected to block pulses produced by the starting aid and ballast from the circuit including heater resistor 28 so that those pulses do not stress the dielectric properties of the electronic circuit elements. The starter pulse would be critically damped without the choke in this location which, as a result, could adversely affect normal lamp ignition.

Heating element 28 is physically mounted in a predetermined thermal relationship with the thermally responsive switch so that the switch will open after a preselected interval of time and if the heating element is subjected to a high voltage differential between the operating and ballast open-circuit voltage for that interval of time. The thermally responsive switch itself is in the nature of a thermostat and commonly includes a bimetallic element which carries a movable contact in a well-known fashion. That movable contact is normally in physical contact with a fixed contact when the thermostat is at a low temperature. As the temperature increases, the bimetallic element deforms and carries the movable contact away, opening the circuit. Thus, the switch portion of the structure is primarily responsive to temperature and has a rather small thermal lag.

During normal lamp operation; element 28 heats to a level well below the activation temperature of the thermostatic switch. This level is dictated by the function $(V_L^2/R_{28})t$ where $V_L$ is the lamp operating voltage. When the lamp is extinguished, the voltage across the element is the open-circuit voltage which is nearly twice the lamp operating voltage. The energy available to heat element 28 is therefore four to six times as great. The element then acts as a thermal integrator. Ultimately, the element would reach a steady state temperature at the higher value also, but that level is higher than the level at which the switch operates.

The heating element 28 dissipates heat on the basis of the electrical power supplied to the element. The amount of that heat which reaches the thermally responsive switch is a function of not only the amount of heat generated by element 28 but also the thermal conductivity of the path between the heating element and the switch. Thus, by introducing a material having known thermal characteristics between the heating element and the switch, it is possible to predetermine a time interval after which the switch will open under known electrical conditions. This material is indicated schematically in FIG. 2 by the barrier 32. The nature of this barrier will be discussed in greater detail hereinafter. A delay of from four to ten minutes of continuous open-circuit voltage can be achieved with this arrangement.

With the circuit of FIG. 2, the characteristics of the thermal switch and heating element assembly are chosen so that sometime after approximately 12 minutes of end-of-life cycling, switch 26 opens, deactivating starting aid circuit 18 and leaving the entire system in a dormant condition. It will be recognized that power is still being supplied from the AC source through ballast 14 to the lamp. However, the voltage applied to the lamp at line frequency is not adequate to restart the lamp. Thus, substantially no current flows through the lamp. Open circuit voltage thus appears across the lamp, and this voltage continues to be applied to heating element 28, maintaining switch 26 in its open condition until power is removed from the entire circuit for an interval of time adequate to allow switch 26 to cool. Thus, as the supply voltage is maintained, no further cycling occurs.

When the lamp is replaced, power is removed from the entire circuit, allowing switch 26 to cool and return to its normally closed condition. When the lamp has been replaced, power is restored and starting aid 18 can cooperate again with ballast 14 to apply starting pulses to the lamp. The cycling typical of a new lamp may then occur, but this cycling exists only for a short interval, insufficient to cause heating element 28 to elevate the temperature of the thermal switch enough to open the switch. In the circuit of FIG. 2, the heating element used was a 5.25 watt wirewound resistor having a value of 35k ohms, switch 26 was a 110° C. thermostat with normally (cold) closed contacts and choke 30 had a value of 55 millihenries.

Figure 3:
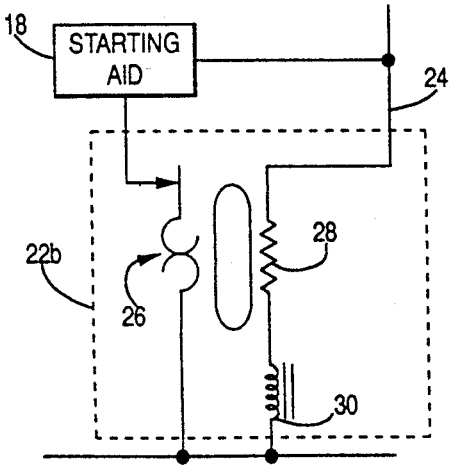
FIG. 3 is a partial schematic diagram showing a second embodiment of a disabling circuit in accordance with the invention.

FIG. 3 shows a relatively minor variation on FIG. 2 in which the thermal switch 26 and heating element 28 through RF choke 30 are independently connected to the common line. This illustrates the fact that choke 30 cooperates particularly with the heating element and further illustrates the fact that the contacts of switch 26 can be used in other ways than simply being connected to the starting aid. This aspect will be referred to again subsequently.

Figure 4:
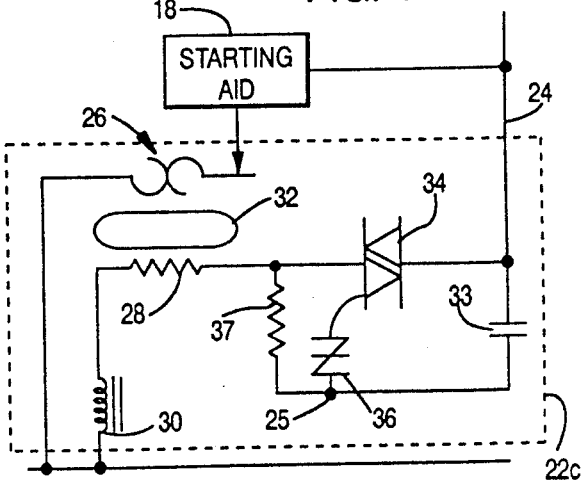
FIG. 4 is a schematic circuit diagram showing a third embodiment of a disabling circuit in accordance with the invention.

FIG. 4 shows a further embodiment of a disabling circuit 22C in accordance with the invention in which switch 26, heating element 28 and choke 30 are connected with respect to each other as in the circuit of FIG. 3, but wherein heating element 28 is connected to conductor 24 through a semiconductor switch device such as a thyristor 34. A voltage responsive breakdown device 36 is connected between junction 25 and the control gate of thyristor 34 to control the voltage level at which the thyristor becomes conductive. A resistor 37 is connected between junction 25 and the cathode of the thyristor. Resistor 37 is in series with a capacitor 33 which provides activation means for breakdown device 36.

The circuit of FIG. 4 functions in substantially the same manner as the circuits of FIGS. 2 and 3 but provides considerably more precise control over the time delay provided by the thermally responsive switch assembly. By appropriate selection of the type and number of voltage responsive devices 36 (2 or more of which may be connected in series) and the value of resistor 37, the tolerance of the thermal response can be greatly reduced.

Figure 5:
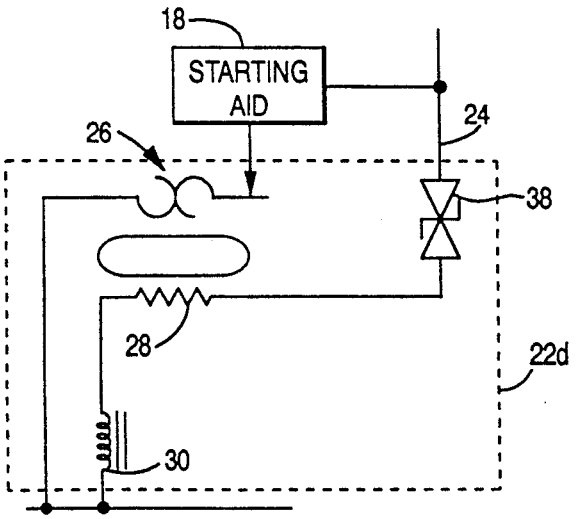
FIG. 5 is a partial schematic diagram showing a fourth embodiment of a disabling circuit in accordance with the invention.

FIG. 5 shows a circuit very similar to FIG. 4 in which an avalanche rectifier 38 such as a zener diode (or a plurality of zener diodes connected in series) are used to control the voltage level over which heating current is applied to heating element 28.

Figure 6:
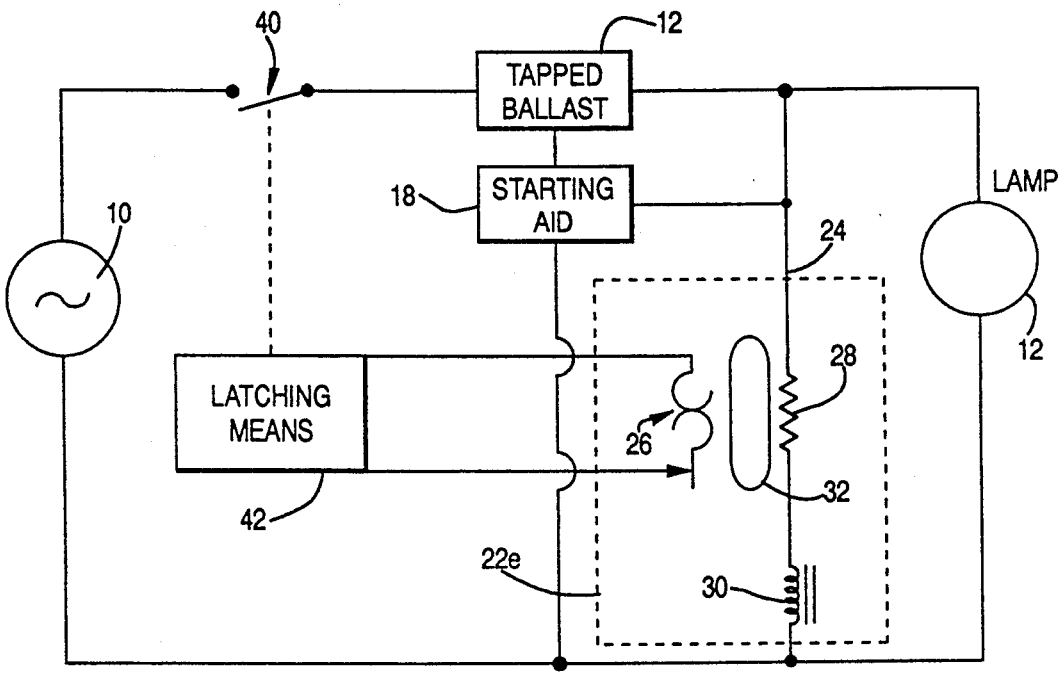
FIG. 6 is a schematic circuit diagram, partly in block form, showing a second embodiment of the overall circuit using a total circuit disabling means.

FIG. 6 shows a circuit which takes a different approach to the deactivation problem in that the power is totally removed from the starting and operating circuit when end-of-life cycling is detected. The AC power source, ballast 12, starting aid 18 and lamp 12 are connected as in FIG. 1 except that a normally closed contact set 40 is provided in series between the AC power source and the ballast. This is especially advantageous when transformer-type ballasts are being used since the open-circuit excitation current can be substantial. Contact set 40 is controlled by a latching circuit means 42 which can be a conventional latching relay or a semiconductor latching circuit. Switch 40 can, of course, also be a semiconductor device although a mechanical contactor is preferred.

The disabling circuit 22*e* includes thermal switch 26 as before, but the two sides of the switch are connected to the latching circuit means 42 rather than to the starting aid. Thus, when the heating element produces sufficient heat to cause thermal switch 26 to open, the latching circuit 42 opens contact set 40, removing all power from the ballast, starting aid, lamp and disabling circuit. This has the advantage of using no power whatsoever once the contacts of switch 26 have been opened, and also has the advantage of a shorter delay when the system is being reset after replacement of lamp. Latching means 42 can be manually reset by pushing a button or the like, depending upon the nature of the latching device used. However, the circuits of FIGS. 2–5 require that power be removed from heating element 28 for an interval of time sufficient to allow the heating element, switch 26 and barrier 32 to cool to its reset level. This process can take, for example, two or three minutes, an interval during which the technician replacing the lamp must simply wait. In the circuit of FIG. 6, the switch begins to cool as soon as soon as contact set 40 has opened and would normally be reset by the time a technician arrives to replace the lamp.

Figure 7:
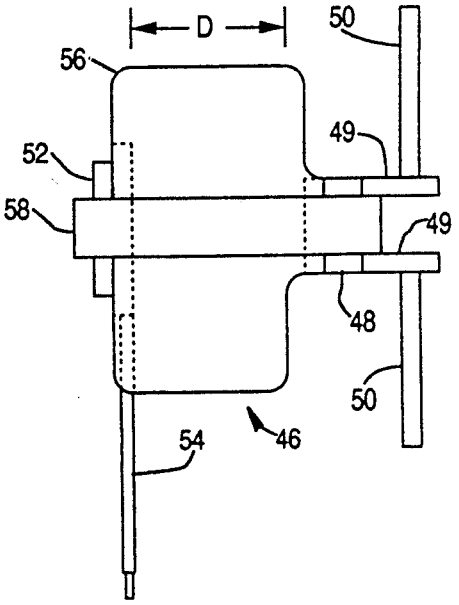
FIG. 7 is a side elevation of a thermally responsive switch and heater assembly in accordance with the invention.

As shown in FIG. 7, the heater-switch assembly indicated generally at 46 which includes switch 26, heating element 28 and thermal barrier 32 of the various disabling circuits shown herein includes a resistor of the conventional wirewound type with a ceramic-coated body 48 and conductors 49 to which leads 50 are attached for connection to other circuit components. A thermostatic switch is housed in a metal container 52 with two wires 54 emerging therefrom. A body 56 of inert filler material is in contact with and between body 48 of the resistor and container 52, maintaining between them a distance D which can be on the order of 5/16 inch, depending on the thermal conductivity of the material of body 56. An endless strip 58 of conventional shrink tubing surrounds the assembly and holds it firmly together.

In the specific embodiment shown, body 56 is made of a ceramic filler material which is purchased as a powder, mixed with water and cured with heat and time to become a rigid, plaster-like mass. This mass has moderately good thermal conductivity but very poor electrical conductivity. One specific material which has proven to be satisfactory is sold under the name Saureisen #8. This ceramic filler has a thermal conductivity of 10 to 12 BTU/ft$^2$/hr/°F./inch and a dielectric strength of 75 to 100 volts/mil. However, other materials such as a piece of molded or extruded plastic could be used.

While certain advantageous embodiments have been chosen to illustrate the invention, it will be understood by those skilled in the art that various changes and modifications can be made therein without departing from the scope of the invention as defined in the appended claims.

We claim:

1. A disabling circuit for deactivating a gas discharge lamp starting and operating circuit when the lamp exhibits end-of-life cycling, the starting and operating circuit being of the type having an AC power source, a ballast connected to said power source, starting circuit means for supplying high-voltage, high-frequency pulses to start an extinguished lamp and lamp circuit means for connecting said starting and operating circuit to a gas discharge lamp, the disabling circuit comprising the combination of a thermal switch having normally closed contacts responsive to a predetermined elevated temperature to open;

a heating element connected in parallel circuit relationship with said lamp circuit means so that the voltage across said lamp is applied to said element;

means for supporting said heating element in a selected heat conducting relationship with said thermal switch so that said predetermined elevated temperature is reached and said contacts are opened after an interval of time and the dissipation of an amount of energy resulting from repeatedly high lamp open-circuit voltage accompanying end-of-life cycling; and latching circuit means connected to said contacts and to said AC source to disconnect said source from said starting and operating circuit when said contacts open and to maintain said source disconnected until said latching circuit means is manually reset;

said means for supporting said heating element in heat conducting relationship with said thermal switch including a mass of polymeric material having a predetermined thickness and means for holding said element and said switch against opposite sides of said mass.

2. A disabling circuit for deactivating a gas discharge lamp starting and operating circuit when the lamp exhibits end-of-life cycling, the starting and operating circuit being of the type having an AC power source, a ballast connected to said AC source, starting circuit means for supplying high-voltage, high-frequency pulses to start an extinguished lamp and lamp circuit means for connecting said starting and operating circuit to a gas discharge lamp, the disabling circuit comprising the combination of a normally closed thermal switch connected in circuit relationship with the starting and operating circuit such that when said switch is open said starting and operating circuit is inoperative, said switch having contacts which open in response to a predetermined elevated temperature;

a heating element connected in parallel circuit relationship with said lamp circuit means so that the voltage across said lamp is applied to said element; and means for supporting said heating element in a selected heat conducting relationship with said thermal switch so that said predetermined elevated temperature is reached and said contacts are opened after an interval of time during which an amount of energy resulting from repeatedly high lamp open-circuit voltage accompanying end-of-life cycling is dissipated.

3. A disabling circuit according to claim 2 wherein said contacts of said switch are connected in series circuit relationship with said starting circuit means.

4. A disabling circuit according to claim 2 and further comprising a radio frequency choke connected in series with said heating element for blocking high-voltage, high-frequency pulses produced by said starting circuit means.

5. A disabling circuit for deactivating a gas discharge lamp starting and operating circuit when the lamp exhibits end-of-life cycling, the starting and operating circuit being of the type having an AC power source, a ballast connected to said power source, starting circuit means for supplying high-voltage, high-frequency pulses to start an extinguished lamp and lamp circuit means for connecting said starting and operating circuit to a gas discharge lamp, the disabling circuit comprising the combination of a thermal switch having normally closed contacts responsive to a predetermined elevated temperature to open;

a heating element connected in parallel circuit relationship with said lamp circuit means so that the voltage across said lamp is applied to said element;

means for supporting said heating element in a selected heat conducting relationship with said thermal switch so that said predetermined elevated temperature is reached and said contacts are opened after an interval of time and the dissipation of an amount of energy resulting from repeatedly high lamp open-circuit voltage accompanying end-of-life cycling; and latching circuit means connected to said contacts and to said AC source to disconnect said source from said starting and operating circuit when said contacts open and to maintain said source disconnected until said latching circuit means is manually reset.

6. A disabling circuit according to claim 5 and further comprising a radio frequency choke connected in series with said heating element for blocking high-voltage, high-frequency pulses produced by said starting circuit means.

7. A disabling circuit for deactivating a gas discharge lamp starting and operating circuit when the lamp exhibits end-of-life cycling, the starting and operating circuit being of the type having an AC power source, a ballast connected to said AC source, starting circuit means for supplying high-voltage, high-frequency pulses to start an extinguished lamp and lamp circuit means for connecting said starting and operating circuit to a gas discharge lamp, the disabling circuit comprising a combination of a normally closed thermal switch connected in circuit relationship with the starting and operating circuit such that when said switch is open said starting and operating circuit is inoperative, said switch having contacts which open in response to a predetermined elevated temperature;

a heating element connected in parallel circuit relationship with said lamp circuit means so that the voltage across said lamp is applied to said element;

voltage responsive breakdown means connected in series circuit relationship with said heating element to apply energy to said heating element when the lamp voltage exceeds a predetermined threshold; and means for supporting said heating element in a selected heat conducting relationship with said thermal switch so that said predetermined elevated temperature is reached and said contacts are opened after an interval of time and the dissipation of an amount of energy resulting from repeatedly high lamp open-circuit voltage accompanying end-of-life cycling.

8. A disabling circuit for deactivating a gas discharge lamp starting and operating circuit when the lamp exhibits end-of-life cycling, the starting and operating circuit being of the type having an AC power source, a ballast connected to said power source, starting circuit means for supplying high-voltage, high-frequency pulses to start an extinguished lamp and lamp circuit means for connecting said starting and operating circuit to a gas discharge lamp, the disabling circuit comprising the combination of a thermal switch having normally closed contacts responsive to a predetermined elevated temperature to open;

a heating element connected in parallel circuit relationship with said lamp circuit means so that the voltage across said lamp is applied to said element;

means for supporting said heating element in a selected heat conducting relationship with said thermal switch so that said predetermined elevated temperature is reached and said contacts are opened after an interval of time and the dissipation of an amount of energy resulting from repeatedly high lamp open-circuit voltage accompanying end-of-life cycling;

voltage responsive breakdown means connected in series circuit relationship with said heating element to apply energy to said heating element when the lamp voltage exceeds a predetermined threshold; and latching circuit means connected to said contacts and to said AC source to disconnect said source from said starting and operating circuit when said contacts open and to maintain said source disconnected until said latching circuit means is manually reset.

9. A disabling circuit for deactivating a gas discharge lamp starting and operating circuit when the lamp exhibits end-of-life cycling, the starting and operating circuit being of the type having an AC power source, a ballast connected to said AC source, starting circuit means for supplying high-voltage, high-frequency pulses to start an extinguished lamp and lamp circuit means for connecting said starting and operating circuit to a gas discharge lamp, the disabling circuit comprising the combination of a normally closed thermal switch connected in circuit relationship with the starting and operating circuit such that when said switch is open said starting and operating circuit is inoperative, said switch having contacts which open in response to a predetermined elevated temperature;

a heating element connected in parallel circuit relationship with said lamp circuit means so that the voltage across said lamp is applied to said element; and means for supporting said heating element in a selected heat conducting relationship with said thermal switch including a mass of polymeric material having a predetermined thickness and means for holding said element and said switch against opposite sides of said mass so that said predetermined elevated temperature is reached and said contacts are opened after an interval of time and the dissipation of an amount of energy resulting from repeatedly high lamp open-circuit voltage accompanying end-of-life cycling.

* * * * *